United States Patent [19]

March

[11] Patent Number: 4,591,047

[45] Date of Patent: May 27, 1986

[54] CALADRYL DISPLAY

[75] Inventor: David March, New York, N.Y.

[73] Assignee: Thomson Leeds Company Inc., New York, N.Y.

[21] Appl. No.: 641,026

[22] Filed: Aug. 15, 1984

[51] Int. Cl.[4] ..... B65D 5/52; B65D 85/20

[52] U.S. Cl. ..... 206/45.18; 206/45.14; 206/45.19; 206/634; 211/59.2; 248/174; 312/45

[58] Field of Search ..... 206/45.19, 45.18, 44 R, 206/45.14, 634; 312/45; 248/174; 211/59.2

[56] References Cited

U.S. PATENT DOCUMENTS

| | | | |
|---|---|---|---|
| 1,840,439 | 1/1932 | Ewell | 211/59.2 |
| 1,930,321 | 10/1933 | Ogden | 312/45 |
| 2,231,091 | 2/1941 | Saulsbury | 229/27 |
| 2,940,710 | 6/1960 | Adams | 248/174 |
| 4,011,943 | 3/1977 | Galli et al. | 206/44 R |
| 4,138,052 | 2/1979 | Torigian | 206/443 |
| 4,232,799 | 11/1980 | Housman | 248/174 |
| 4,274,613 | 6/1981 | Taub | 248/174 |
| 4,384,651 | 5/1983 | Smith | 248/174 |
| 4,411,382 | 10/1983 | Taub | 206/45.25 |
| 4,454,949 | 6/1984 | Flum | 206/564 |

FOREIGN PATENT DOCUMENTS

| | | | |
|---|---|---|---|
| 501602 | 3/1939 | United Kingdom | 312/45 |

*Primary Examiner*—William Price
*Assistant Examiner*—Brenda J. Ehrhardt
*Attorney, Agent, or Firm*—Howard C. Miskin

[57] ABSTRACT

An article display and dispensing structure includes a cardboard base unit collapsible to a lay flat condition and having side walls with upwardly rearwardly inclined edges on the lower part of which is located a separable platform panel and an inclined container unit resting on the inclined edges and platform and enclosing a partition unit having open topped longitudinal passageways slideably carrying end to end bottles, the container being closed by a swingable rectangular cover releasably locked in closed position by Velcro coupling sections and having a transverse line of weakness delineating with the bottom front edge of the cover member a separable panel whose separation provides access to the lowermost bottles for individual removal.

13 Claims, 8 Drawing Figures

FIG. 1
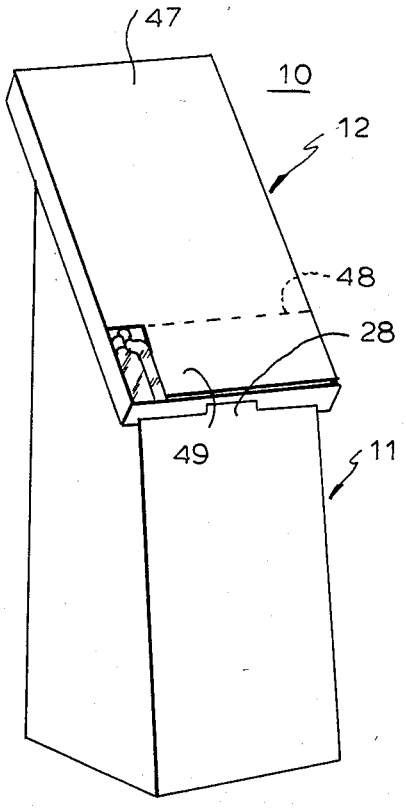
FIG. 2
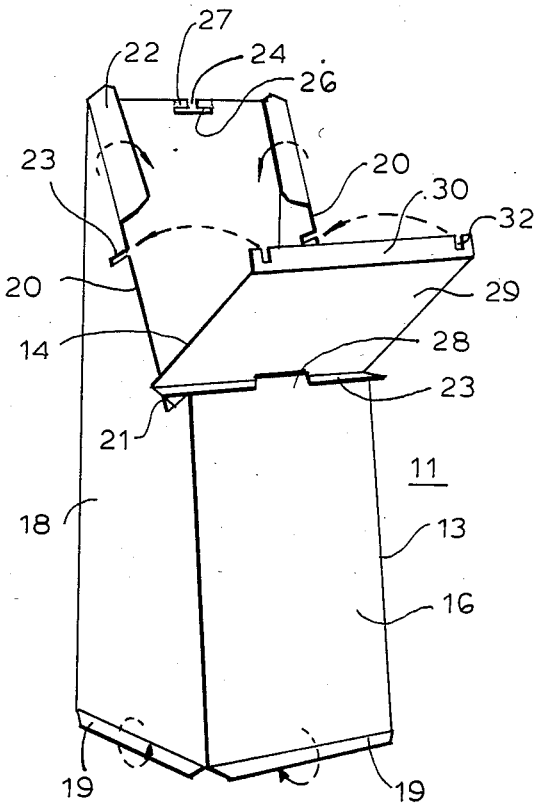
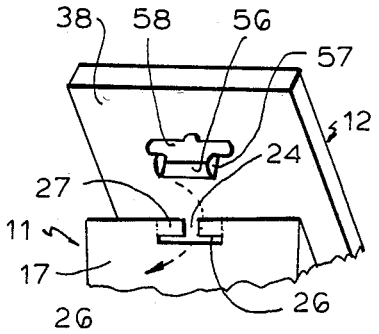
FIG. 3

CALADRYL DISPLAY

BACKGROUND OF THE INVENTION

The present invention relates generally to improvements in display and dispensing devices and it relates particularly to an improved collapsible structure for displaying a product and facilitating the individual dispensing of the product and the replenishment of the depleted product.

In the merchandising of many products, the products are conventionally prepackaged in small individual containers such as bottles, jars, small cartons and the like, examples of such products being lotions and solid and liquid medications of various type. The prepackaged products are usually displayed on and dispensed from permanently constructed shelves or are located on counters where they are exhibited in a similar manner. However, it is frequently necessary or desirable to display and dispense a product in an area separate from the usual product display area where the product is readily observable and obvious and where it is conveniently available and dispensable. Heretofore many structures and arrangements have been proposed and employed for displaying and dispensing prepackaged products in areas displaced or isolated from the usual product and article display and dispensing areas, such as shelves, counters and the like. However, these earlier structures possess numerous drawbacks and disadvantages. They are expensive structures, awkward and time consuming to assemble, inconvenient and unreliable to operate, unattractive, of little versatility and adaptability and otherwise leave much to be desired.

SUMMARY OF THE INVENTION

It is thus a principal object of the present invention to provide an improved display and dispensing device.

Another object of the present invention is to provide an improved device for displaying and individually dispensing prepackaged products.

Still another object of the present invention is to provide an improved display device for individually dispensing products prepackaged in small bottles, jars, cartons and the like.

A further object of the present invention is to provide an improved product display and dispensing device which is collapsible to a highly compact state to facilitate its storage and shipping and in which the dispensed product packages may be easily and quickly replenished.

Still a further object of the present invention is to provide an improved device of the above nature characterized by its reliability, attractive appearance, ease and convenience of assembly and use and its great versatility and adaptability.

A display and dispensing device in accordance with the present invention includes a collapsible base unit advantageously formed of cardboard or the like, having, in its erected condition, relatively low front and relatively high rear walls and side walls hinged along adjacent edges, the side walls having coplanar, parallel rearwardly upwardly inclined top edges, a prepackaged product dispensing unit having a bottom wall resting on the top portion of the base unit and restricted against downward movement and including a cover panel swingable between open and closed positions and releasably locked in its closed position, the cover panel having an opening in its lower border, providing access to the interior of the container unit and a partition member having transversely spaced longitudinal package guideways nested in the container unit. Advantageously, inwardly directed flaps are formed at the upper portions of the side wall edges and a platform rests on the lower portions of the side edges and underlies the container unit bottom wall and coupling means are formed on the base unit rear wall and the container unit bottom wall interlocking the base and container unit.

The improved display and dispensing unit is easy to quickly erect and assemble without the use of tools, is convenient and reliable to use, is inexpensive, rugged and highly attractive and is of great versatility and adaptability.

BRIEF DESCRIPTION OF THE DRAWINGS

FIG. 1 is a front perspective view of a display and dispensing device embodying the present invention shown in an assembled and erected condition;

FIG. 2 is a front perspective view of the base portion thereof shown in the process of assembly;

FIG. 3 is a rear fragmentary perspective view of the device shown in the process of interlocking the container and base portions thereof;

DESCRIPTION OF THE PREFERRED EMBODIMENT

Figure 4:
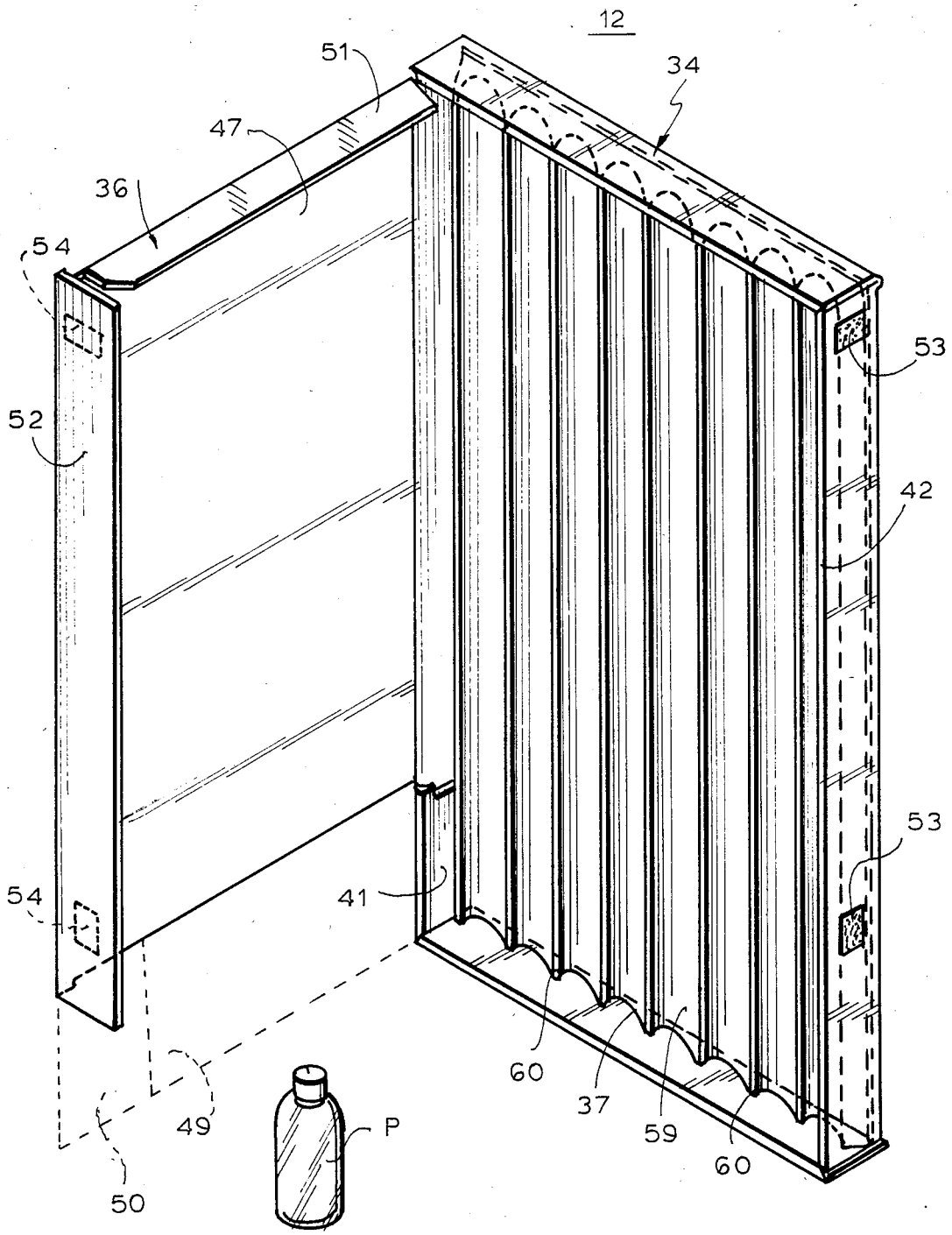
FIG. 4 is a front perspective view of the container portion as shown in detached and open condition.
Figure 5:
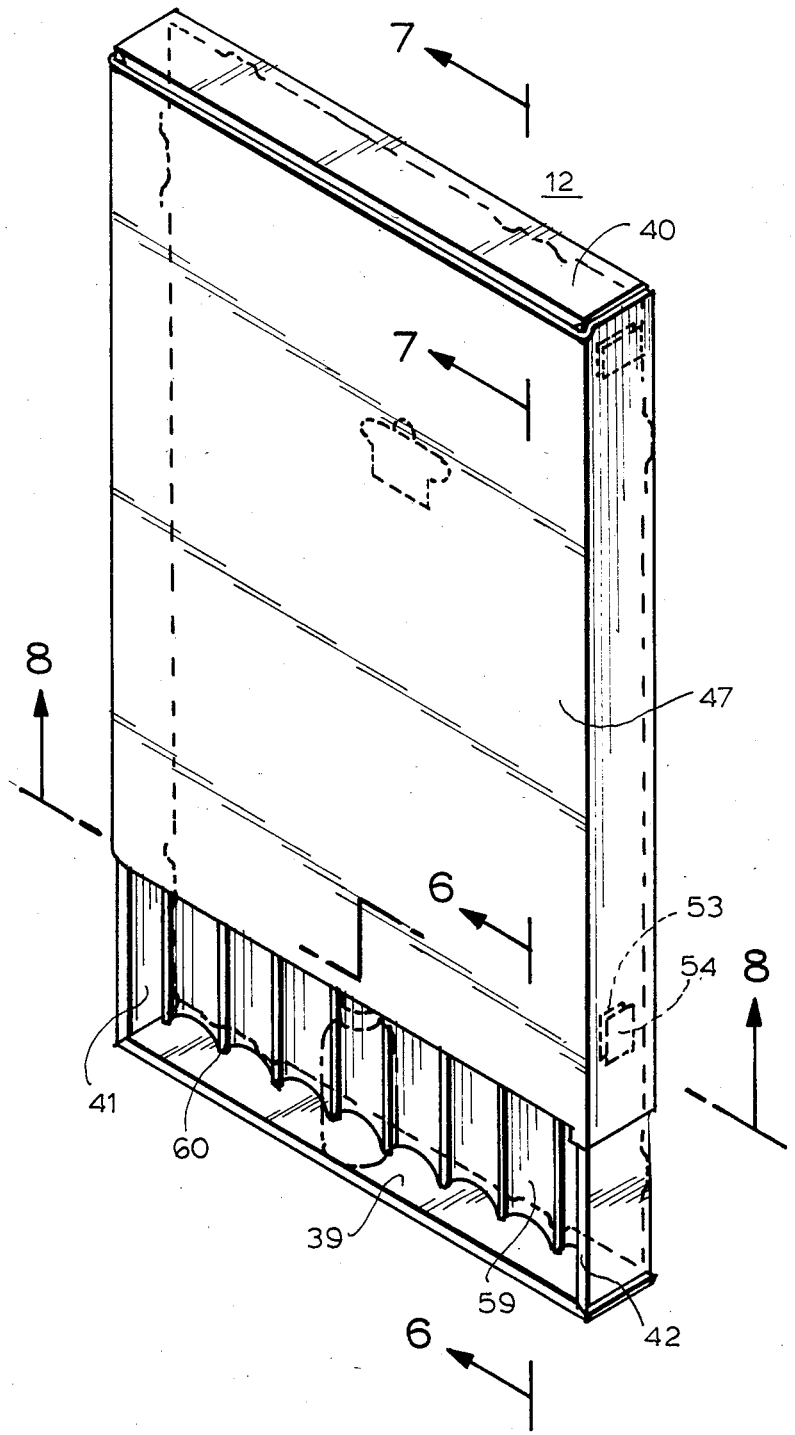
FIG. 5 is a view similar to FIG. 4 but with the container shown in closed condition.
Figure 6:
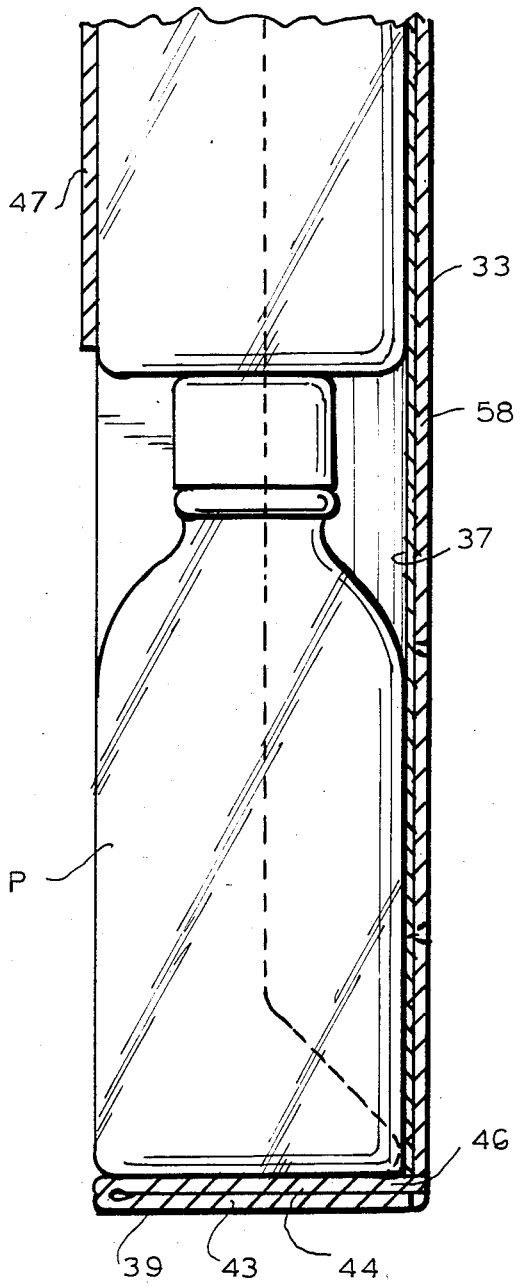
FIG. 6 is a sectional view taken along line 6—6 in FIG. 5.
Figure 7:
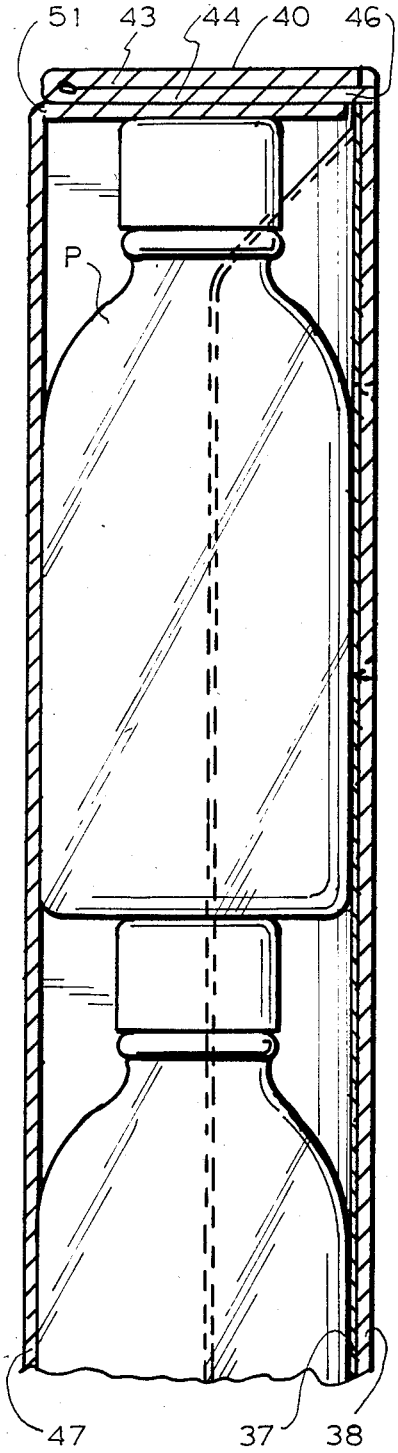
FIG. 7 is a sectional view taken along line 7—7 in FIG. 5.
Figure 8:
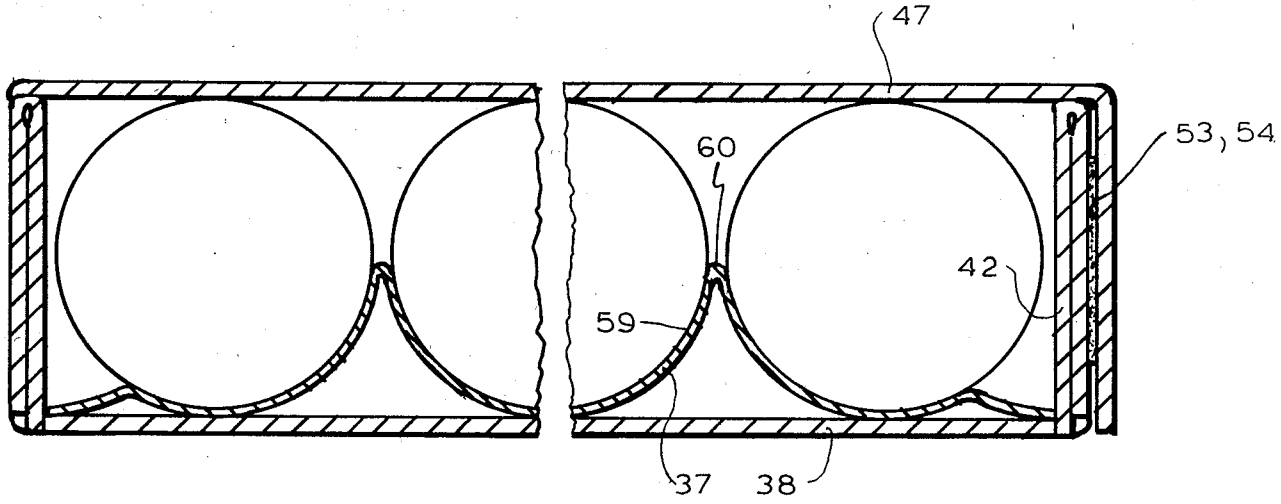
FIG. 8 is a sectional view taken along line 8—8 in FIG. 5.

Referring now to the drawings which illustrate a preferred embodiment of the present invention, the reference numeral 10 generally designates the improved display and dispensing device which comprises a base unit 11 and a container unit 12. The base unit 11 is formed of two sections, a body section 13 integrally formed preferrably of cardboard in the conventional manner by stamping and shaping and a platform section 14 likewise stamped and shaped preferrably of cardboard.

The base unit body section 13 includes a rearwardly upwardly inclined short rectangular front wall 16 and an upright high rear wall 17. Extending between and self or live hinged to corresponding edges of front and rear walls 17 are similarly shaped side walls 18, walls 16,17 and 18 being formed of a single sheet with the free contiguous edges of the sheet being joined in any suitable manner to form body member 13. Formed along the bottom edges of and integral with walls 16,17 and 18 are flaps 19 which are folded inwardly to define foot pieces.

The top edges 20 of side walls 18 are parallel and coplanar and rearwardly upwardly inclined preferrably at an angle greater than 45 degrees to the horizontal, each of the edges 20 terminating at its front end in a shoulder defining edge 21 perpendicular to and projecting upwardly from respective inclined edge 20. A flap 22 is formed along the upper portion of each inclined edge 20 and a notch, perpendicular to inclined edge 20 is formed in the upper border of each side wall 18 intermediate the ends of edge 20. Medially formed in the upper border of rear wall 17 is a vertical slot 24 joining a horizontal slot 26 which delineate the bottom and inner spaced confronting edges of a pair of hinged flaps 27. Projecting medially upwardly from and coplanar with front wall 16 is a short tab 28.

Platform section 14 includes a rectangular panel 29 of greater width than the distance between side walls 18 and of a length about equal to the distance between slots 23 and shoulders 21. A downwardly projecting flap 30 extends along the full length of the rear edge of panel 29 and is provided with notches 32 which engage slots 23 and a flap 33 projects upwardly from the front edge of panel 29 and shoulders 21 in the assembled erected condition of base unit 11.

The container unit 12 comprises a body portion 34, a cover member 36 and a guideway insert 37. Body portion 34 is formed of a unitary cardboard blank and includes a rectangular bottom wall 33, front and rear walls 39 and 40 and side walls 41 and 42 projecting perpendicular from the edges of bottom wall 38 and coextensive therewith. Each of walls 39–42 includes an outer panel 43 joined along its lower edge to bottom wall 38 and an inner panel 44 joined along the upper edge of outer panel 43 and provided along its bottom edge in a plurality of longitudinally spaced depending tabs 46 engaging corresponding slots in bottom wall 38.

Cover member 36 includes a main rectangular panel 47 suitably hinged along a longitudinal edge thereof to the top edge of body portion side wall 41. A score line 48 parallel to the front edge of panel 47 is formed in panel 47 a distance from the bottom edge thereof slightly greater than the length of a bottle or other package P dispensed by device 10. A score line 48 delineates a forward separable panel whose detachment from panel 47 exposes the bottom row of products P when cover 36 is in closed position. It should be noted that panel 49 may have a rectangular cut-out 50 at its inner end to expose one of the products P even in the closed condition of cover member 36.

Closure top and free end side flaps 51 and 52 project perpendicularly inwardly from corresponding edges of panel 47, and in the closed condition of cover member 47 flap 31 engages the inside face of rear wall 40 and flap 52 engages the outside face of side wall 42. Cemented to the outside face of side 42 is a pair of longitudinally spaced rectangular Velcro sheet separable fastener units 53 and cemented to the inside face of flap 52 is a pair of correspondingly spaced rectangular Velcro sheet units 54 which separably engage respective fastener units 53 in the closed condition of cover member 36 to releasably lock the cover member in its closed condition.

Integrally formed with and stamped from the medial rear border of container unit bottom wall 38 is a depending locktab 56 having laterally extending hinged butterfly or wing flaps 57. A corresponding opening 58 is formed in bottom wall 38, locktab 56 being swingably connected to the front lateral edge of opening 58. A notch is medially formed in the top edge of opening 58 to provide finger access to tab 56.

Nesting in the lower portion of container body portion 34 and resting on bottom wall 38 and extending between front and rear walls 39 and 40 and side walls 41 and 42 is guideway insert 37 which is formed of a unitary sheet of cardboard or other suitable material. Insert 37 is shaped to form a plurality of parallel side-by-side longitudinally extending guideways 59 of arcuate transverse cross-section of somewhat less than 180 degrees and of a diameter about equal to that of product bottle P. The adjacent edges of successive guideways 59 are integrally joined by cusps 60.

In the collapsed condition of base unit 11 body member 13 is folded along the hinge lines between contiguous edges of walls 16,17 and 18 to a lay flat condition with flaps 19 and 20 being coplanar with corresponding walls. To assemble the device 10 the body member walls 16,17 and 18 are swung to their expanded position as shown in FIGS. 1 and 2 and the flaps 19 and 22 are swung inwardly. The base unit is then locked in its erected position by applying platform member 14 with flap 33 bearing on the rear face of tab 28 and the notches 32 engaging slots 23 to retain the body member and platform in the erected assembled condition.

The lock tab 56 is opened and swung downwardly from the bottom wall of container unit 12 which is positioned above platform 14 and the opposite wing flaps 57 are folded inwardly and the tab thus inserted through slot 26. Wing flaps 57 are then opened up to securely lock container unit 12 and base unit 11 with the dispensing and display device in assembled erected condition.

The panel 49 is detached and separated from the remainder of cover panel 47 along score line 48 to expose and provide access to the bottom row of bottles P which are slideably located end to end as columns in guideways 59. As a bottom bottle P is withdrawn through the bottom opening the column of successive end to end bottles is gravity fed downwardly along the respective guideway to replace the withdrawn bottle. When the bottles in the container are depleted they are replenished merely by unlocking flap 42 by separating fastener members 53 and 54, opening cover member 46, filling guideways 59 with bottles P and then closing and relocking cover member 36.

While there has been described and illustrated a preferred embodiment of the present invention it is apparent that numerous omissions, additions and alterations may be made without departing from the spirit thereof.

I claim:

1. A display and dispensing device comprising:

a hollow base unit collapsible to a lay flat condition and including upright relatively short front and long rear walls and side walls extending between corresponding edges of said front and rear walls and hingedly connected thereto, said side walls having coplanar upwardly rearwardly inclined top edges;

a separate platform panel resting on and extending laterally between and beyond the lower portion of said base unit side wall top edges and being coupled and restricted against lateral and forward movement relative to said base unit; and a product container unit having a bottom wall separably resting on said platform panel and being restricted against downward movement from a predetermined position along said platform panel, said container unit including front, rear and side walls projecting upwardly from the corresponding edges of said bottom wall and having an opening in the top thereof providing access to the interior of said container.

2. The device of claim 1 wherein said container unit bottom wall extends rearwardly of and rests on the top edge of said base unit rear wall.

3. The device of claim 2 including coupling means integrally formed on said base unit rear wall upper border and said container unit bottom wall interlocking said rear wall and bottom wall.

4. The device of claim 1 wherein the front ends of said base unit side wall top edges terminate in upwardly forwardly directed shoulder defining edges perpendicular to said top edges, said shoulder defining edges being parallel to said container unit front wall.

5. The device of claim 1 including flaps hinged to said base unit side walls at the upper portions of said base unit side wall top edges and underlying said container unit bottom wall.

6. The device of claim 4 wherein said platform panel has along its front edge an upwardly projecting flap engaging said shoulder defining edges.

7. The device of claim 1 wherein said container unit includes a cover member joined to and swingable about the upper edge of one of said container unit side walls to alternatively open and close the top of said container unit.

8. The device of claim 1 wherein said cover member includes a main upper panel and a lower panel detachably joined to and coplanar with said upper panel, detachment of said lower panel providing said access opening to the interior of said container unit with said cover member in closed condition.

9. A container unit comprising a rectangular bottom wall, rectangular front rear and side walls of substantially equal height integrally formed with and projecting upwardly from the edges of said bottom wall, a partition member extending longitudinally between said front and rear walls and including transversely spaced longitudinally extending guideways in each of which guideways a plurality of dispensable products of predetermined length are disposed longitudinally end to end, a cover member swingable about the upper longitudinal edge of a first of said side walls between an open position exposing the interior of the container unit and a closed position, means releasably locking said cover member in closed position, said cover member having a front edge and a transverse line of weakness parallel to and longitudinally spaced from said front edge and delineating a separable panel whose removal provides product dispensing access through the resulting opening substantially only to the forward products in said guideways.

10. The container unit of claim 9 wherein the longitudinal dimension of said panel is approximately equal to that of one of said products in said passageways.

11. The container unit of claim 10 wherein said cover member includes a flap along its outer side edge and said locking means includes sections of Velcro correspondingly located on the outside face of said side wall opposite to said first side wall and the inside face of said flap, said Velcro sections being in separable engagement in the cover member closed portion.

12. The container unit of claim 9 wherein said partition member comprises a unitary sheet resting on said bottom wall and extending between said side walls and between said front and rear walls and shaped to provide side by side passageways of semicircular transverse cross-section.

13. In combination with the container unit of claim 9 a base member separably supporting said container unit in an upwardly rearwardly inclined position.

* * * * *